US005494412A

United States Patent [19]

Shin

[11] Patent Number: 5,494,412

[45] Date of Patent: Feb. 27, 1996

[54] OIL DELIVERY PREVENTION DEVICE FOR HORIZONTAL TYPE ROTARY COMPRESSOR

[75] Inventor: Chang J. Shin, Seoul, Rep. of Korea

[73] Assignee: Goldstar Co., Ltd., Rep. of Korea

[21] Appl. No.: 231,273

[22] Filed: Apr. 22, 1994

[30] Foreign Application Priority Data

Apr. 26, 1993 [KR] Rep. of Korea ..... 7040/1993

[51] Int. Cl.[6] ..... F04B 39/04

[52] U.S. Cl. ..... 417/313; 418/DIG. 1; 55/485; 55/486; 55/489

[58] Field of Search ..... 417/313, 366, 417/902; 418/DIG. 1; 55/485, 486, 489

[56] References Cited

U.S. PATENT DOCUMENTS

| | | | |
|---|---|---|---|
| 2,111,936 | 3/1938 | Murphy | 55/485 |
| 2,833,373 | 5/1958 | Custer | 55/429 |
| 2,983,435 | 5/1961 | Burnell | 418/87 |
| 3,478,957 | 11/1969 | Marlin et al. | 418/89 |
| 3,499,270 | 3/1970 | Paugh | 418/DIG. 1 |
| 3,572,008 | 3/1971 | Mankinsow | 55/33 |
| 3,684,412 | 8/1972 | Marlin | 418/DIG. 1 |
| 3,776,668 | 12/1973 | Abendschein | 418/DIG. 1 |
| 3,820,924 | 6/1974 | Cassidy | 418/DIG. 1 |
| 4,717,316 | 1/1988 | Muramatsu et al. | 417/902 |
| 5,391,066 | 7/1995 | Sawai | 418/DIG. 1 |

FOREIGN PATENT DOCUMENTS

| | | | |
|---|---|---|---|
| 4279790 | 10/1992 | Japan | 418/DIG. 1 |
| 4321789 | 11/1992 | Japan | 418/DIG. 1 |
| 4321787 | 11/1992 | Japan | 418/DIG. 1 |
| 5133375 | 5/1993 | Japan | 418/DIG. 1 |
| 5288185 | 11/1993 | Japan | 418/DIG. 1 |

*Primary Examiner*—Richard A. Bertsch
*Assistant Examiner*—Peter G. Koryinyk
*Attorney, Agent, or Firm*—Ostrolenk, Faber, Gerb & Soffen

[57] ABSTRACT

An oil delivery prevention device for a horizontal type rotary compressor for use in a refrigerating system. The device effectively separates the mixed gas into oil and refrigerant gas and prevents the oil from delivery along with the refrigerant gas to the refrigerating cycle. The oil delivery prevention device comprises at least three oil separating nets placed in a motor outer space inside a compressor casing and spaced out at regular intervals. Each of the first and third nets comprises a doughnut net part, a shielding plate provided on a center hole of the doughnut net part and an oil port formed on a lower center of the doughnut net part. The second oil separating net comprises a doughnut shielding plate, a net part provided on a center hole of the doughnut shielding plate and an oil port formed on a lower center of the doughnut shielding plate. The spaces formed between the spaced nets prevent interference between the refrigerant gas and the oil. The oil ports of the nets are formed on the same height positions such that they are leveled and communicate with each other.

7 Claims, 3 Drawing Sheets

OIL DELIVERY PREVENTION DEVICE FOR HORIZONTAL TYPE ROTARY COMPRESSOR

BACKGROUND OF THE INVENTION

1. Field of the Invention

The present invention relates in general to a horizontal type rotary compressor for use in a refrigerating system and, more particularly, to an oil delivery prevention device for the compressor for separation of mixed gas into refrigerant gas and oil and for prevention of oil from delivery along with the refrigerant gas to a refrigerating cycle.

2. Description of the Prior Art

With reference to FIG. 1, there is shown a conventional horizontal type rotary compressor. As shown in this drawing, a compressor casing 1 receives a drive unit D and a compressing unit C which are cooperate with each other through a horizontally placed rotating shaft 6. Oil is received in an oil reservoir of the lower section inside the casing 1.

The drive unit D comprises a stator 12 fixed to an inner surface of the casing 1 and a rotor 11 fixed to the rotating shaft 6. The compressing unit C includes a cylinder 2 which is hermetically covered with a main bearing 4 and a sub-bearing 3 at its opposed ends. The main and sub-bearings 4 and 3 defines a compressing chamber 5 in the cylinder 2.

In the compressing chamber 5 of the compressing unit C, an eccentric part 7 of the rotating shaft 6 axially extends and a roller 8 is fitted over the eccentric part 7. The roller 8 as well as the eccentric part 7 rotates in the compressing chamber 5 as a result of rotation of the rotating shaft 6. The Cylinder 2 of the compressing unit C is provided with a radial slot receiving a radially reciprocating blade **9*b*. This reciprocating blade 9*b* is biased by a compression coil spring 9*d* at its lower end and always elastically contacts with the outer surface of the eccentrically rotating roller 8 of the eccentric part 7 at its distal end. A blade chamber 9*c* is defined below the blade 9*b* and an ON/OFF valve 9*e* is provided at the bottom of the blade chamber 9*c*. Connected to a side wall of the blade chamber 9*c* is an oil feed pipe 9*a* for suction and delivery of the oil O and introduction of the oil O to a shaft bearing 6*a* of the compressing unit C. This oil feed pipe 9*a* is connected to the side wall of the blade chamber 9*c* and a center of the shaft bearing 6*a* at its opposed ends so that the shaft bearing 6*a* communicates with the blade chamber 9*c* through the pipe 9*a***.

In the above horizontal type rotary compressor, an oil delivery prevention device 10 is provided at the right side of the drive unit D as shown in FIG. 2 and adapted to separate a mixed gas into the refrigerant gas and the oil and to prevent the oil from delivery along with the refrigerant gas to a refrigerating cycle. The oil delivery prevention device 10 comprises an oil separating disc 15 which is partially provided with a balance weight member 14 at its edge. Formed on the oil separating disc 15 at a position opposed to the balance weight member 14 is an oil delivery port 16.

In operation of the above oil delivery prevention device 10, the rotor 11 and the rotating shaft 6 are rotated upon applying the electric power to the drive unit D. As a result of rotation of the rotating shaft 6, the roller 8 fitted over the eccentric part 7 of the shaft 6 is eccentrically rotated in the compressing chamber 5, thus to achieve a desired compression in the compressing chamber 5.

At the same time of the eccentric rotation of the roller 8, the reciprocating blade **9*b* contacting with the outer surface of the roller 8 at its distal end radially reciprocates and carries out an oil feeding operation. That is, when the blade 9*b* radially moves upward as shown by the arrow in FIG. 1 such that it enlarges the volume of the blade chamber 9*c*, oil is introduced into the blade chamber 9*c* from the oil reservoir of the lower section of the casing 1**.

When the blade **9*b* radially moves downward in a direction opposed to the arrow direction of FIG. 1 such that it reduces the volume of the blade chamber 9*c*, the oil in the blade chamber 9*c* is introduced into the oil feed pipe 9*a* and thence directed to the shaft bearing 6*a***.

On the other hand, the refrigerant gas is introduced into the compressing chamber 5 through an intake port 9 and a refrigerant gas conduit **8*a*. The refrigerant gas in the compressing chamber 5 is compressed and, thereafter, delivered to a muffler 13 through a valve (not shown). The refrigerant gas delivered from the compressing chamber 5 passes through a compressing unit space $S_1$ in order to be directed to motor inner and outer spaces $S_2$ and $S_3$ by the centrifugal force of the rotor 11**.

At this time, since the pressurized refrigerant gas is mixed with the oil at a high temperature under a high pressure and becomes a refrigerant gas mixture (hereinafter, referred to simply as "mixed gas"), the mixed gas needs be prevented from directly delivered through a delivery pipe **10*a*. In order to achieve the above object in the prior art, the oil delivery prevention device 10 is provided at the right side of the drive unit D, that is, at the rear side of the rotating shaft 6. With the oil delivery prevention device 10, the mixed gas whirls and comes out between the rotor 11 and the stator 12 owing to the centrifugal force of the rotor 11 during rotation of the rotor 11. Thereafter, the mixed gas coming out between the rotor 11 and the stator 12 strikes against the oil separating disc 15 vertically placed at the rear side of the rotor 11 and the stator 12. At this time, part of the mixed gas whirls in the motor inner space $S_2$ and thence delivered from the oil delivery port 16 by way of the motor outer space $S_3$. The other mixed gas gathers in the motor outer space $S_3$ through the gap between the oil separating disc 15 and the stator 12. The mixed gas gathering in the motor outer space $S_3$ is somewhat separated into refrigerant gas and oil and delivered through the delivery pipe 10*a*. That is, when the mixed gas strikes against the oil separating disc 15, it is separated into refrigerant gas and oil due to the surface tension. The separated oil sticks to the oil separating disc 15 and, thereafter, drops down to the oil reservoir of the casing 1** due to the gravity.

However, the above oil delivery prevention device has a problem that the oil separating disc does not make the most of its intrinsic function. Another problem of the above device is resided in that it can not achieve a desired complete separation of the oil from the mixed gas since part of mixed gas simply passes through the gap between the stator and the oil separating disc, thus to deteriorate efficiency of the associated refrigerating cycle.

SUMMARY OF THE INVENTION

It is, therefore, an object of the present invention to provide an oil delivery prevention device for a horizontal type rotary compressor in which the aforementioned problems can be overcome and which effectively separates the mixed gas into the oil and the refrigerant gas and prevents the oil from delivery along with the refrigerant gas to the refrigerating cycle.

In order to accomplish the above object, an oil delivery prevention device for a horizontal type rotary compressor in accordance with the present invention comprises a plurality of oil separating nets placed in a motor outer space inside a compressor casing and spaced out at regular intervals, each of the oil separating nets comprising a net part and a shielding plate.

In a preferred embodiment, the oil delivery prevention device comprises three nets, that is, first to third nets which are vertically placed in order in the motor outer space from the motor unit to the delivery port. Each of the first and third nets comprises a doughnut net part, a shielding plate provided on a center hole of the doughnut net part and an oil port formed on a lower center of the doughnut net part. The second oil separating net comprises a doughnut shielding plate, a net part provided on a center hole of the doughnut shielding plate and an oil port formed on a lower center of the doughnut shielding plate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 3:
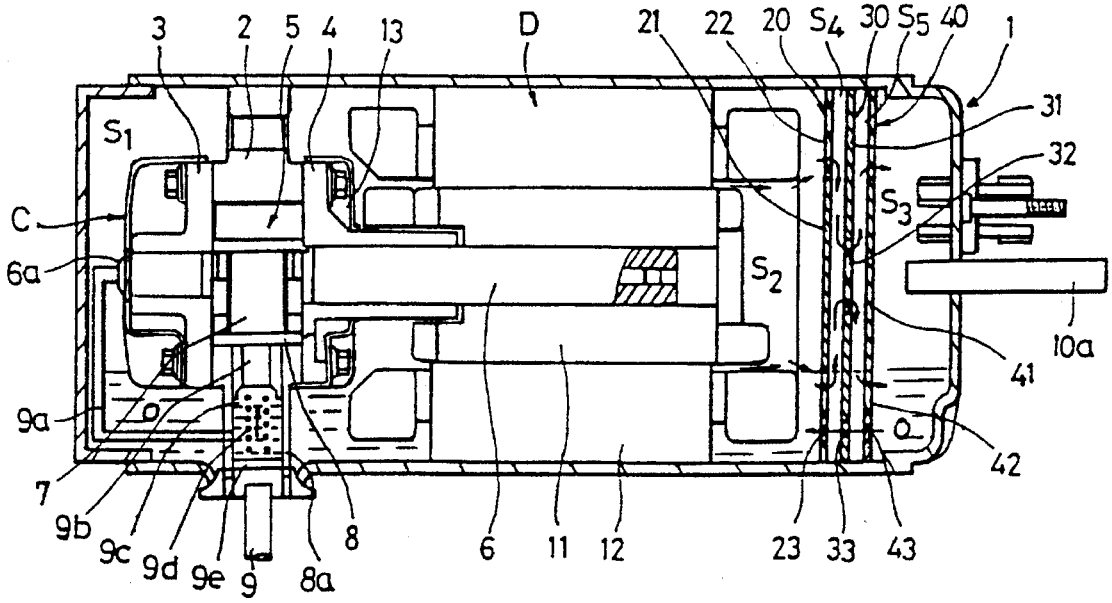
FIG. 3 is a sectional view of a horizontal type rotary compressor with an oil delivery prevention device of the present invention.

FIG. 3 is a sectional view of a horizontal type rotary compressor with an oil delivery prevention device according to a preferred embodiment of the present invention. In the same manner as the prior art horizontal type rotary compressor, a drive unit D and a compressing unit C which are cooperate with each other through a horizontally placed rotating shaft 6 are received in a horizontal type compressor casing 1. Oil is contained in an oil reservoir of the lower section inside the casing 1. In the preferred embodiment of the present invention, the oil delivery prevention device comprises three oil separating nets 20, 30 and 40 which are placed in a motor outer space S3 inside the compressor casing 1 and spaced out at regular intervals as shown in FIGS. 3 and 4A to 4C.

Here, it should be understood that the number of the oil separating nets of the oil delivery prevention device of the present invention is not limited to the three. For example, the oil delivery prevention device of this invention may comprise four or more oil separating nets for improvement of oil strength.

Figure 4A:
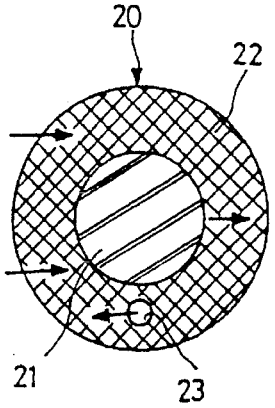
FIGS. 4A to 4C are plan views of three oil separating nets constituting an oil delivery prevention device according to an embodiment of the present invention, respectively.
Figure 4B:
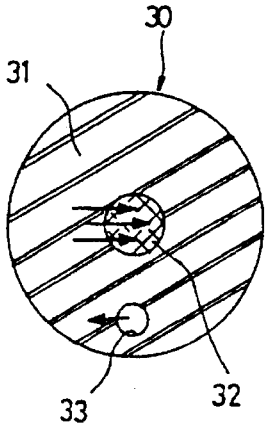
Figure 4C:
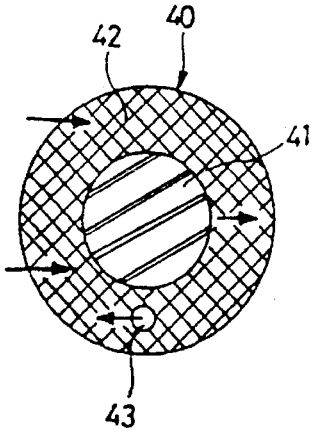

As shown in FIGS. 4A to 4C, the oil delivery prevention device according to the preferred embodiment of this invention comprises three oil separating nets, that is first to third nets 20, 30 and 40. Each of the first and third nets 20 and 40 comprises a doughnut net part 22 or 42, a shielding plate 21 or 41 provided on a center hole of the net part 22 or 42 and an oil port 23 or 43 formed on a lower section of the net part 22 or 42 as shown in FIGS. 4A and 4C.

The second oil separating net 30, interposed between and regularly spaced apart from the first and third nets 20 and 40, has a center hole smaller than those of the first and third nets 20 and 40. As shown in FIG. 4B, the second net 30 comprises a doughnut shielding plate 31, a net part 32 provided on the center hole of the shielding plate 31 and an oil port 33 formed on a lower section of the shielding plate 31. Here, the oil port 33 of the second net 30 is leveled with the oil ports 23 and 43 of the first and third nets 20 and 40 and communicates with them when the first to third nets 20, 30 and 40 are vertically placed at the rear side of the drive unit D.

In mounting the oil separating nets 20, 30 and 40 at the rear side of the drive unit D in the casing 1, the nets 20, 30 and 40 are vertically placed such that they are spaced apart from each other at regular intervals and form spaces $S_4$ and $S_5$ therebetween. The spaces $S_4$ and $S_5$ between the nets 20, 30 and 40 are formed in the motor outer space $S_3$. Since the nets 20, 30 and 40 are spaced apart from each other at regular intervals and form the spaces $S_4$ and $S_5$ between them as described above, there is no interference between the oil O and the refrigerant gas.

Figure 1:
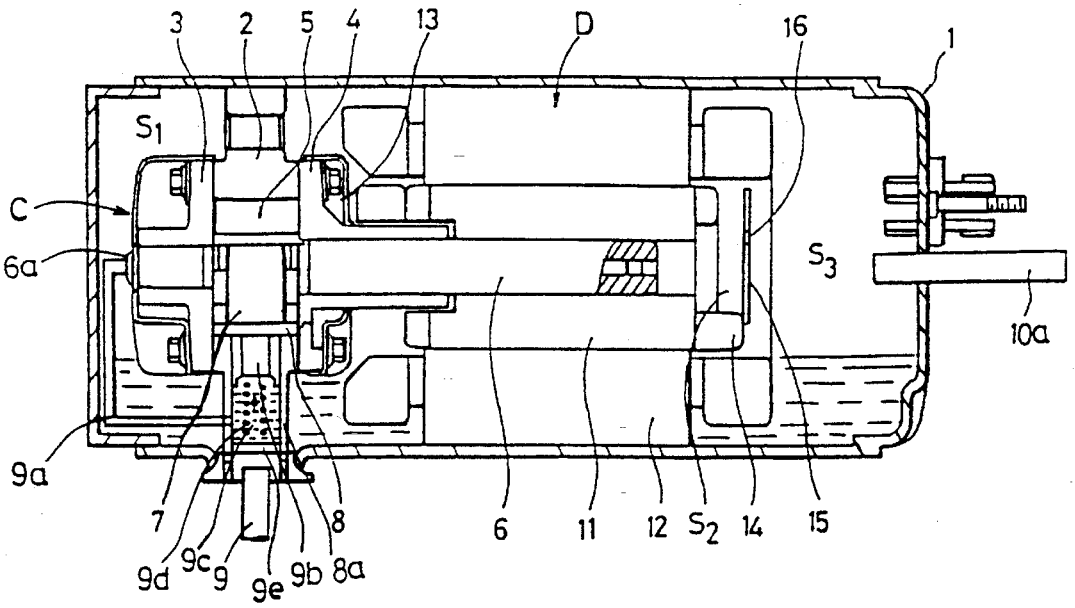
FIG. 1 CONVENTIONAL ART
FIG. 1 is a sectional view of a conventional horizontal type rotary compressor.
Figure 2:
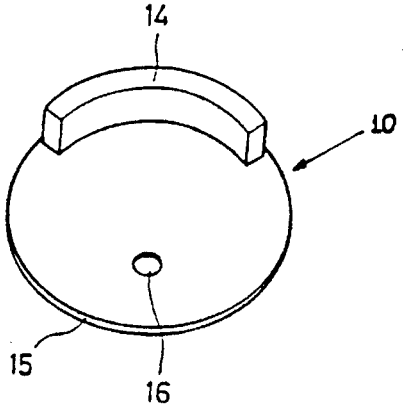
FIG. 2 CONVENTIONAL ART
FIG. 2 is a perspective view of an oil separating disc of a conventional oil delivery prevention device for the rotary compressor.

In the horizontal type rotary compressor having the device of this invention shown in FIG. 3, most of the elements are common with those of the conventional compressor of FIG. 1, so that those elements common to both the conventional compressor and the present compressor will thus carry the same reference numerals.

Hereinbelow, the operation of the rotary compressor having the oil delivery prevention device of this invention will be described.

The general operation of the compressor is similar to that of the conventional compressor and detailed explanation is thus not deemed necessary but schematic explanation will be given. In operation of the rotary compressor, the rotor 11 and the rotating shaft 6 are rotated upon applying the electric power to the drive unit D. The mixed gas coming out between the rotor 11 and the stator 12 owing to the centrifugal force of the rotor 11 gathers in the motor inner space $S_2$.

The mixed gas first strikes against the first oil separating net 20. At this time, part of the mixed gas striking against the net part 22 of the first net 20 is scarcely separated into the refrigerant gas and the oil but simply passes through the net part 22 so as to be introduced into the space $S_4$ between the first and second nets 20 and 30. The other mixed gas striking against the shielding plate 21 of the first net 20 is mostly separated into the refrigerant gas and the oil. Here, the separated oil O provisionally sticks to the shielding plate 21 and, thereafter, drops down to the oil reservoir owing to the gravity while the refrigerant gas passes through the net part 22 about the shielding plate 21 in order to be introduced into the first space $S_4$.

The mixed gas and the refrigerant gas having passes through the net part 22 of the first net 20 strike against the shielding plate 31 of the second net 30 spaced apart from the first net 20 by the predetermined distance. At this time, the mixed gas directly striking against the shielding plate 31 is mostly separated into the refrigerant gas and the oil. Here, the separated oil O provisionally sticks to the shielding plate 31 and, thereafter, drops down to the oil reservoir owing to the gravity. On the contrary, the refrigerant gas separated by this shielding plate 31 and the refrigerant gas separated by the first net 20 pass through the net part 32 of the second net 30 in order to be introduced into the second space $S_5$.

The remaining mixed gas still retaining its mixed state after passing through the first and second nets 20 and 30 is separated into the refrigerant gas and the oil by the third net 40 which is spaced apart from the second net 30 by the predetermined distance. That is, the remaining mixed gas strikes against the shielding plate 41 of the third net 40, thus to be separated into the refrigerant gas and the oil. The oil separated by the third net 40 sticks to the shielding plate 41 and drops down to the oil reservoir while the refrigerant gas passes through the net part 42 of the third net 40 in order to be directed to the delivery pipe 10*a* and supplied to the refrigerating cycle. As described above, the mixed gas passes through the first to third oil separating nets 20, 30 and 40 and completely separated into the refrigerant gas and the oil. Only the refrigerant gas separated from the oil passes through the delivery pipe 10*a*.

Each of the first to third oil separating nets 20, 30 and 40 comprises a shielding plate and a net part so that the mixed gas composed of refrigerant gas and oil strikes the shielding plates and is repeatedly separated into the refrigerant gas and the oil owing to the surface tension. The separated oil drops down to the oil reservoir owing to the gravity.

That is, in the oil delivery prevention device of the rotary compressor of the present invention, the mixed gas strikes against the shielding plates 21, 31 and 41 of the first to third nets 20, 30 and 40, which nets are spaced out at regular intervals, so that it is separated into the refrigerant gas and the liquid oil. Here, the separated liquid oil provisionally sticks to the shielding plates 21, 31 and 41 and drops down to the oil reservoir in the compressor casing 1 due to the gravity while the separated refrigerant gas passes through the net parts 22, 32 and 42 of the first to third nets 20, 30 and 40 in order to be delivered through the delivery pipe 10*a*. Here, there is part of mixed gas which is not separated into the refrigerant gas and the oil but passes through the net parts of the nets. When the part of mixed gas passes through the net parts 22, 32 and 42 of the oil separating nets, the liquid oil of the mixed gas sticks to the net parts while the refrigerant gas simply passes through the net parts. The oil sticking to the net parts drops down to the oil reservoir in the compressor casing 1 due to the gravity for reuse.

As described above, the oil delivery prevention pipe for the horizontal type rotary compressor in accordance with the present invention comprises a plurality of oil separating nets vertically placed at the rear side of the drive unit such that they are spaced out at regular intervals. Each of the nets comprises a shielding plate and a net part. The device completely separates the mixed gas into the refrigerant gas and the oil and supplies the refrigerant gas to the refrigerating cycle while draining the oil to the oil reservoir in the compressor casing for reuse. In this regard, the device of the present invention reliably prevents the oil from delivery along with the refrigerant gas through the delivery pipe to the refrigerating cycle so that it prevents deterioration of operation efficiency of the refrigerating cycle.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An oil delivery prevention device for a horizontal type rotary compressor for use in a refrigerating system comprising:

a plurality of oil separating nets provided in a motor outer space between a motor unit and a refrigerant gas delivery port inside a compressor casing and spaced out at regular intervals, each of said oil separating nets comprising a net part and a shielding plate, said net part passing mixed gas therethrough while said shielding plate separates said mixed gas into refrigerant gas and oil and drains said oil to an oil reservoir in said compressor casing.

2. The oil delivery prevention device according to claim 1, wherein said oil separating nets comprise first, second and third nets which are vertically placed in series in said motor outer space from said motor unit to said delivery port.

3. The oil delivery prevention device according to claim 2, wherein each of said first and third nets comprises:

a doughnut net part;

a shielding plate provided on a center hole of said doughnut net part; and an oil port formed on a lower center of said doughnut net part.

4. The oil delivery prevention device according to claim 2, wherein said second oil separating net comprises:

a doughnut shielding plate;

a net part provided on a center hole of said doughnut shielding plate; and an oil port formed on a lower center of said doughnut shielding plate.

5. The oil delivery prevention device according to claim 2, wherein said first, second and third oil separating nets include respective oil ports, said oil ports being formed at the same height position such that they are leveled and communicate with each other.

6. The oil delivery prevention device according to claim 1, wherein said oil separating nets comprise at least three nets.

7. The oil delivery prevention device according to claim 1, wherein said oil separating nets spaced out at regular intervals form spaces therebetween for prevention of interference between said refrigerant gas and said oil.

* * * * *